US006151001A

United States Patent [19]

Anderson et al.

[11] Patent Number: 6,151,001

[45] Date of Patent: Nov. 21, 2000

[54] METHOD AND APPARATUS FOR MINIMIZING FALSE IMAGE ARTIFACTS IN A DIGITALLY CONTROLLED DISPLAY MONITOR

[75] Inventors: Edward C. Anderson, Northwood; David E. Olm, Toledo; Jerry D. Schermerhorn, Perrysburg, all of Ohio

[73] Assignee: Electro Plasma, Inc., Millbury, Ohio

[21] Appl. No.: 09/016,655

[22] Filed: Jan. 30, 1998

[51] Int. Cl.[7] ..... G09G 5/28

[52] U.S. Cl. ..... 345/63; 345/68; 345/148

[58] Field of Search ..... 345/55, 60, 62, 345/63, 67, 68, 89, 147, 148; 315/169.4

[56] References Cited

U.S. PATENT DOCUMENTS

| | | | |
|---|---|---|---|
| 3,937,876 | 2/1976 | Amsen et al. | 178/7.3 |
| 4,006,298 | 2/1977 | Fowler et al. | 358/240 |
| 4,559,535 | 12/1985 | Watkins et al. | 340/793 |
| 4,602,273 | 7/1986 | Carlson | 358/11 |
| 5,068,649 | 11/1991 | Garrett | 345/89 |
| 5,185,002 | 2/1993 | Venturini | 604/30 |
| 5,187,578 | 2/1993 | Kohgami et al. | 358/168 |
| 5,430,458 | 7/1995 | Weber | 345/60 |
| 5,541,618 | 7/1996 | Shinoda | 345/60 |
| 5,731,802 | 3/1998 | Aras et al. | 345/147 |
| 5,898,414 | 4/1999 | Awamoto et al. | 345/155 |
| 6,052,112 | 4/2000 | Tanaka et al. | 345/147 |

*Primary Examiner*—Steven J. Saras
*Assistant Examiner*—Tewolde Mengisteab
*Attorney, Agent, or Firm*—MacMillan, Sobanski & Todd, LLC

[57] ABSTRACT

This invention is directed to improve visual effects on digital display devices that use time and space modulation methods to display grayscale values. A distributed line technique is utilized to provide grayscale capability. The grayscale display is illuminated by energizing pixels of a weighted grid of eight line addresses. The first grid line illuminates pixels based on the first selected bit of the grayscale value for those pixels, the second grid line pixels are illuminated based on the second selected bit of the grayscale value for those pixels, the third grid line pixels are base on the third selected bit of the grayscale value for those pixels, etc. until all pixels for all eight grid lines have been selected. Thereafter, a second set of grid lines is accessed during the second addressing period, a third set is accessed during the third addressing period, and so forth until all grid sets have been accessed. There are N grid sets where N is the number of time slots allocated per frame time. The visual grayscale brightness of each pixel is determined by the selection of the grid sets and the time slot allocated for the grid sets. The bit value selection, grid set allocation, and time slots are chosen such that the grayscale values are scattered in time and space so that the perception of visual disturbances and other perceived artifacts are avoided.

20 Claims, 13 Drawing Sheets

METHOD AND APPARATUS FOR MINIMIZING FALSE IMAGE ARTIFACTS IN A DIGITALLY CONTROLLED DISPLAY MONITOR

FIELD OF THE INVENTION

The present invention relates to a method and apparatus for minimizing false image artifacts in a digitally controlled display monitor systems, including CRT's commonly used for television and computer terminals. More particularly, the present invention relates to a method and apparatus for minimizing false image artifacts in digital displays that have pixels with only binary luminous states. It will be appreciated that this is a preferred mode for many flat panel display technologies, and the only mode for some. Perception of grayscale must be accomplished solely by digital modulation in time or space or both resulting in the appearance of unwanted image artifacts.

BACKGROUND OF THE INVENTION

Grayscale shading can be generated on a screen of an analog display such as a cathode ray tube (CRT) by varying the brightness control voltage at the control input to the analog display. The analog display uses this varying voltage to modulate the brightness of each pixel and thus produce the grayscale level. Unfortunately, this same grayscale shading technique does not lend itself to digitally commanded displays such as multiplexed liquid crystal displays (LCDs), light emitting diode (LED) displays, electroluminescent (EL) displays, field emission displays (FEDs), or plasma displays wherein individual pixels (discrete light source regions including emissive, transmissive, and reflective types) can be commanded to switch towards only one of two brightness levels, ON or OFF (i.e. white or black). Such digital displays generally lack an analog control and therefore do not have a direct means independent of their power lines for commanding a pixel towards an intermediate brightness level (grayscale) between black and white.

Multiplexed displays typically have only two electrodes provided at each pixel area for addressing a pixel area and energizing the pixel area to either produce the appearance of a fully lit (white) pixel or to produce the appearance of a fully darkened (black) pixel. Since an analog means for controlling brightness level is not available on many types of digital displays, alternative digital techniques have been proposed for giving a viewer the perception of grayscale shading.

One of the proposed alternative techniques is a so-called "pulse-width modulation" scheme wherein the width of pixel energizing pulses is modulated between wide and narrow values to create a grayscale effect.

There have been proposed several methods for providing the gradation of the display brightness using pulse-width modulation schemes, such as U.S. Pat. No. 4,006,298, Japanese article "TV Display on an AC plasma Panel" by K. Takikawa, or Japanese Patent Publication 51-32051 or Hei2-291597, wherein a single frame period of a picture to be displayed is divided with time into multiple subframes (G1, G2, G3, etc.) each of which has a specific time length for lighting a cell so that the visual brightness of the cell is weighted. This method is illustrated in FIG. 1 wherein pixels on a single horizontal line are selectively written and illuminated for a specific length of time, pixels on the next horizontal line are then written and display for the specific length of time, etc. until all lines have been written and displayed. Gradation of visual brightness is proportional to the length of time that the pixel is illuminated during the frame. Therefore, different time lengths are allocated to the subframes such that the gradation is determined by an accumulation of display time in the selectively operated subframes.

One problem of this method is in that the second subframe must wait until the completion of the first subframe for all lines to be written thus creating an idle period for each line. This idle time has the effect of diluting the gradation technique by introducing additional off time that precludes the use of a full white (100% gradation level) pixel. To minimize the idle time, high frequency writing and drive circuits are required which results in increased power consumption and usually less operating margin.

A second method of "pulse-width modulation" has been proposed in U.S. Pat. Nos. 4,559,535; 5,187,578 and 5,541,618 wherein a single frame period of a picture to be displayed is divided with time into multiple subframes (G1, G2, G3, etc.) each of which has a specific time length for lighting a cell so that the visual brightness of the cell is weighted. This method is illustrated in FIG. 2 wherein all pixels in the display are written with one addressing pulse and then pixels are selectively erased based on the grayscale value for that subframe. Illuminated pixels are displayed for the specific length of time and then erased prior to activating the next subframe. This method eliminates the idle time previously described and has the further advantage of "priming" all pixels before they are displayed, if this is important in the technology. Thus it removes any time effects that may occur as the image changes since there are no time gradients produced that may become visible to the eye.

A third method involves an ordered dither arrangement such as described in U.S. Pat. No. 3,937,878 wherein grayscale levels are displayed as a distribution of pixels whose spatial density is ordered such that the distribution represents the amount of light emanating from a specific location of the display. The technique may be enhanced by applying hysteresis methods well known in the art to the incoming signal such that the distribution (grayscale value) for the area is only changed when a significant change in the signal occurs. This technique avoids the small changes in grayscale values that usually occurs in digitizing an analog signal. Other space distribution methods of displaying grayscale values have been reported such as described in U.S. Patent No. 5,185,002.

A problem with all of the aforementioned digital techniques is the occurrence of flickering, surface streaming, line crawl, contouring, and/or color change artifacts. The article by Takikawa, cited above, described these disturbances and their cause (but incompletely) as early as 1977. In brief, these artifacts are due to the ability of the human eye to preferentially detect motion and patterns. An appreciation of this aspect can be gained from the physiochemistry and construction of the eye and optic nerve path to the brain, such as described in the Feynman Lectures on Physics, volume I, pp. 35-1 and 2. The interesting thing is that in the retina of our eye, each of the cells which is sensitive to light is not connected by a fiber directly to the optic nerve, but is connected to many other cells, which are themselves connected to each other. There are several kinds of cells; there are cells that carry the information toward the optic nerve, but there are others that are mainly interconnected "horizontally." The main thing is that the light signal is already being "thought about" before it reaches to the brain. That is to say, the information from the various cells does not immediately go to the brain, spot for spot, but in the retina a certain amount of the information has already been digested, by a combining of the information from several visual receptors. It is therefore understood that some brain-function phenomena occurrs in the eye itself Thus, the eye is sensitive to patterns and motion as well as the viewing of a pretty scene.

The time/space relationship of digital pulses in display systems leads to these psychovisual phenomenon. The eye and brain perceives certain pulsing patterns of a digital image as having unexpected patterns or moving portions. To be sure, such artifacts are, to some extent, familiar even on film movies and TV CRT display systems which are all basically digitalized in time. TV's flicker badly and have obvious interlace separation with moving images. Home film movies were good examples of flicker and jitter, and wagon wheels "appear" to go backwards even in the best movie theaters. Such "false image artifacts" can become more severe in display images which are digitized in both time and space. In this case contour streaming, false colors, and false movements as well as flicker many also be perceived.

Such digital image artifacts are well known in the display industry and various methods have been devised to mitigate or minimize them. Such techniques include adding "leveling" pulses such as in U.S. Pat. No. 5,430,458 and as described in the literature, for example 1997 SID Symposium Digest paper 19.1 "Performance Features of a 42 in. Diagonal Color Plasma Display, T. Hirose, et. al. Other techniques involve image preprocessing to detect motion and in certain cases eliminate frames in order to achieve images more pleasing to the eye. For example, U.S. Pat. No. 4,602,273 describes a display with image filters to avoid line-crawl artifacts in particular.

SUMMARY OF THE INVENTION

It is an object of the invention to provide a device and method of producing a high degree of luminous gradation, or grayscale, on digital displays. It is another object of the invention to distribute the grayscale modulation in both time and in space in a manner which minimizes the perception of false image artifacts due to digitalization.

According to our method and circuit of driving the digital display, a period for each line having the same value as the frame period for displaying a line is divided into a plurality of sequential sub-periods. Each sub-period is predetermined differently according to the weight given to each sub-period. Grayscale brightness for the line is determined by the accumulation of illumination for each sub-period as determined by the brightness level specified in a picture data for each pixel on the line.

The sub-period distribution is similar for all lines with each line being assigned an offset in time for its sub-period distribution. The offsets are distributed by dividing the frame time into N parts where N is the number of lines in the display. Offsets for any given line may be assigned sequentially or in random order. During each offset time, a grid of eight lines is modified to display a different sub-period value for those lines based on the weighting value for the pixels on those lines. Assignment of the lines for each grid will spatially distribute the sub-period assignments while the sub-periods distribute the grayscale values in time. This novel arrangement spreads the pulsing in both time and space such that it appears "random " and "scattered" and eliminates substantially all "false" patterns which would otherwise be generated and perceived as artifacts.

A BRIEF DESCRIPTION OF THE DRAWINGS

Further features and other objects and advantages of the invention will become clear from the following detailed description made with reference to the drawings in which:

FIG. 1 schematically illustrates a prior art structure of a frame to drive each line of a digital display panel;

FIG. 2 schematically illustrates a structure of sub-frame addressing to drive each line of a digital display panel;

Figure 7A:
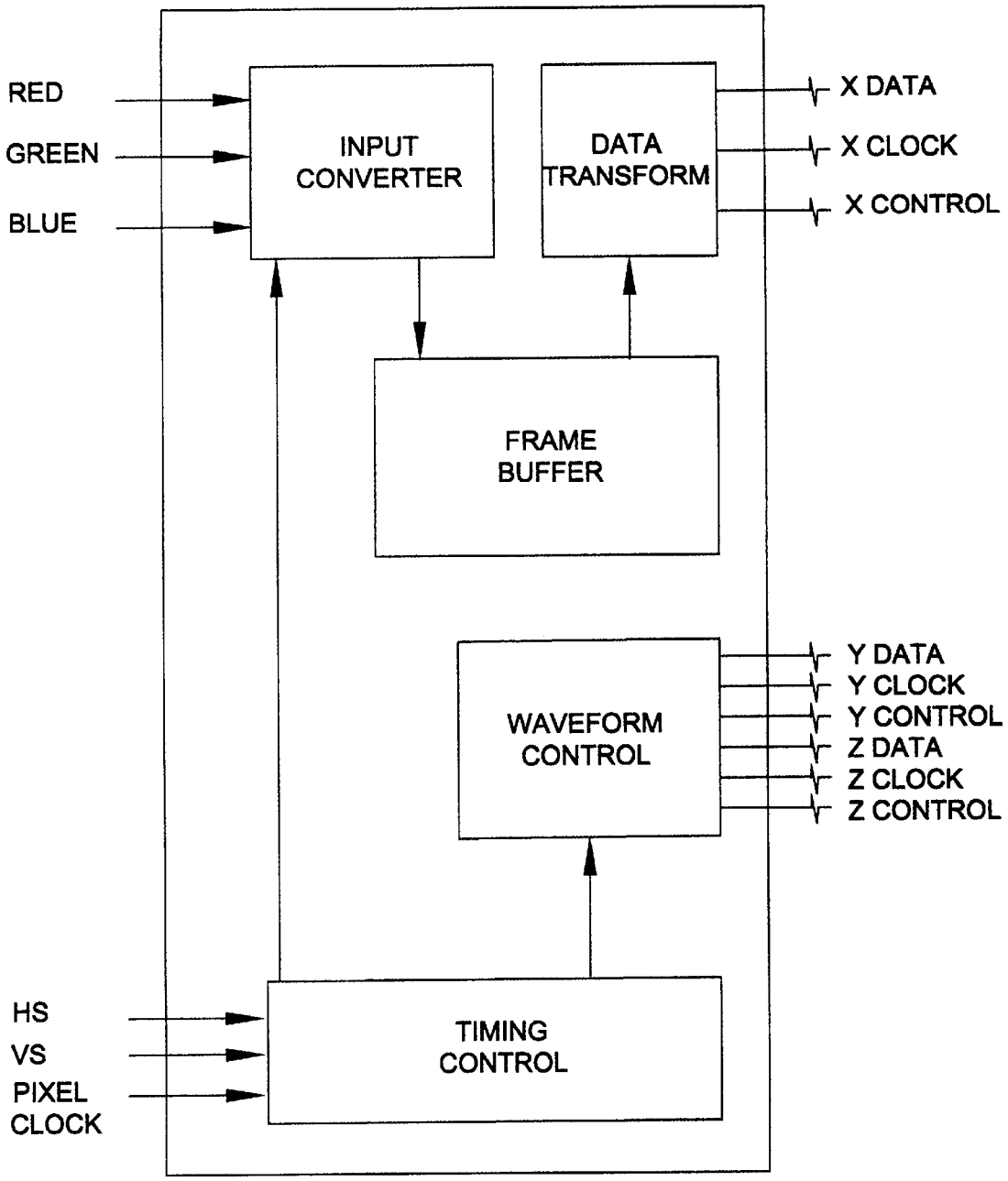
Figure 7B:
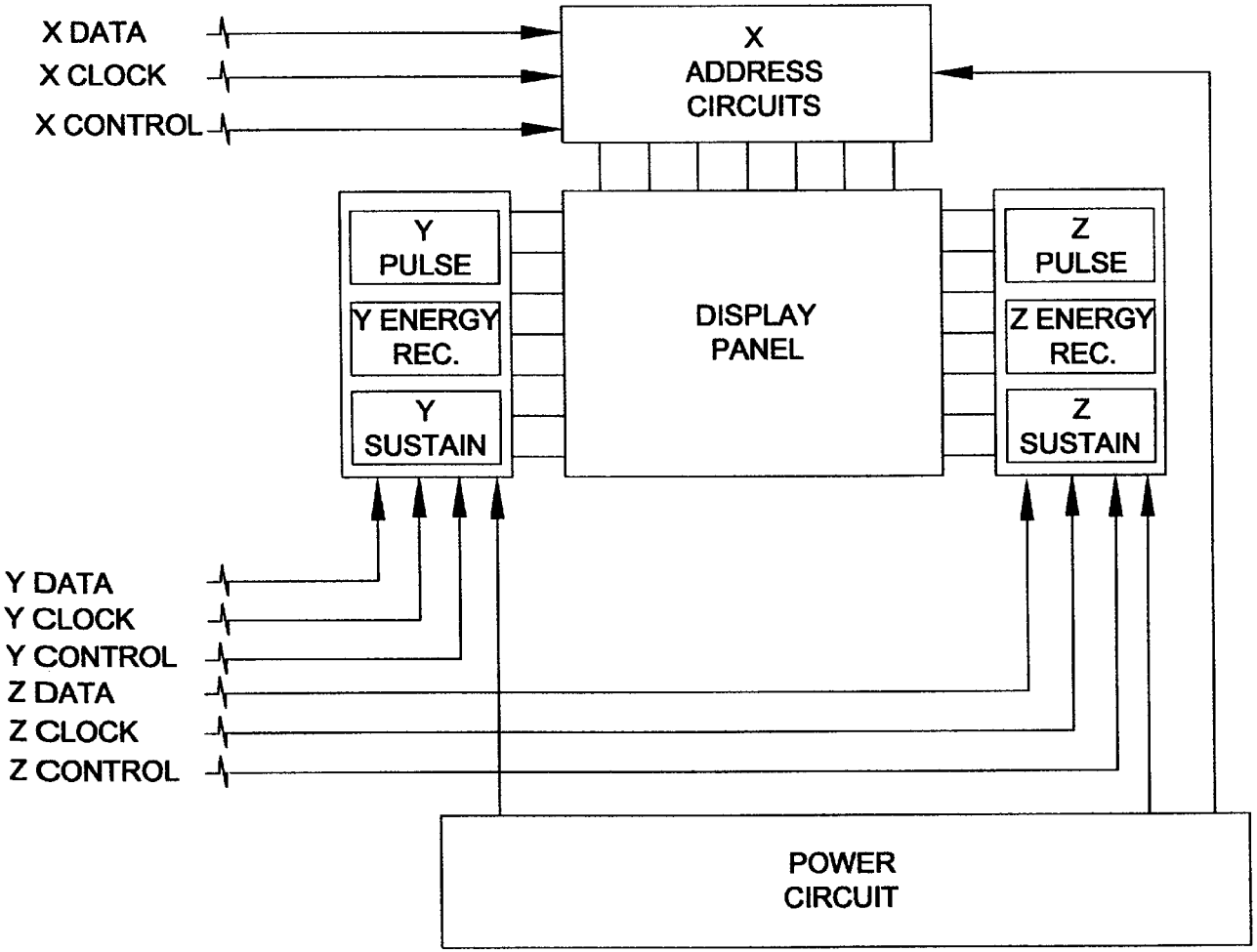
Figure 8:
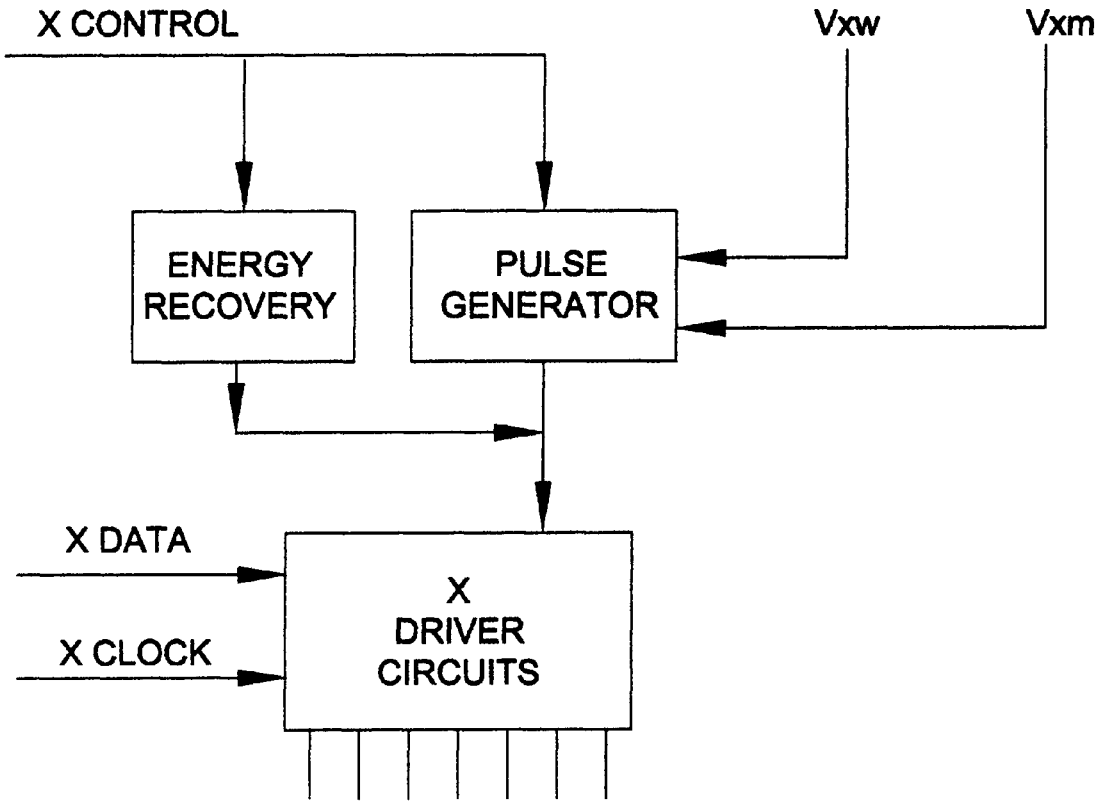
Figure 9:
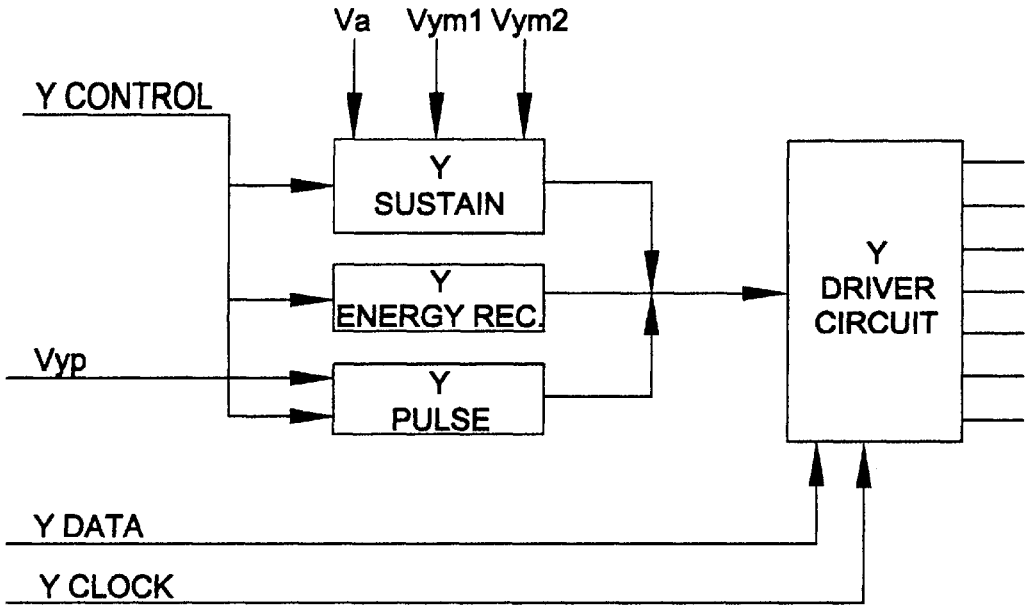
Figure 10:
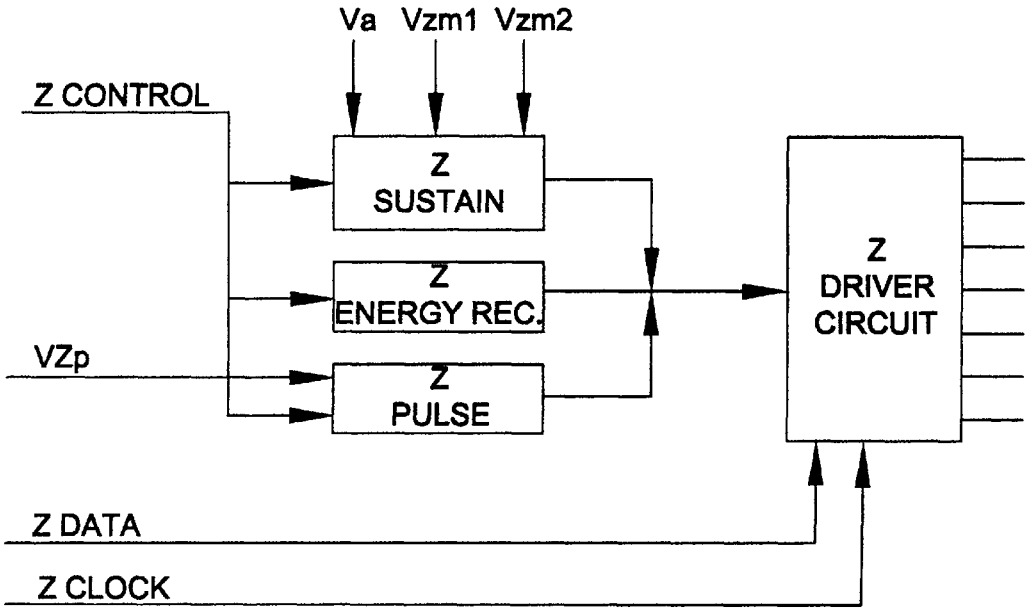
Figure 11:
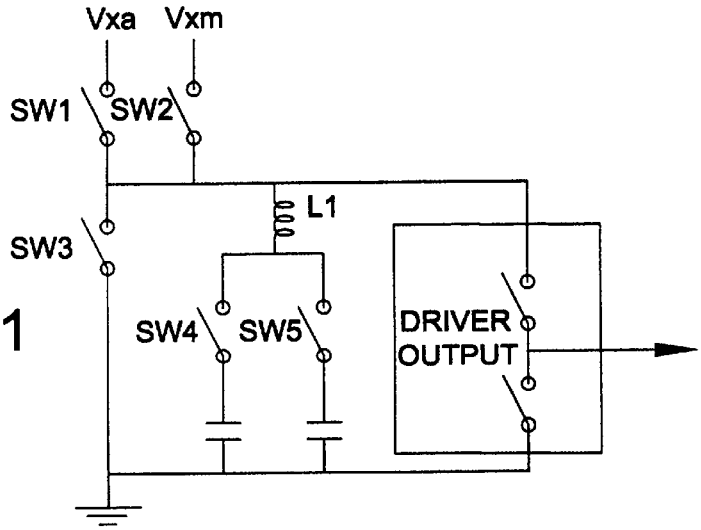
Figure 12:
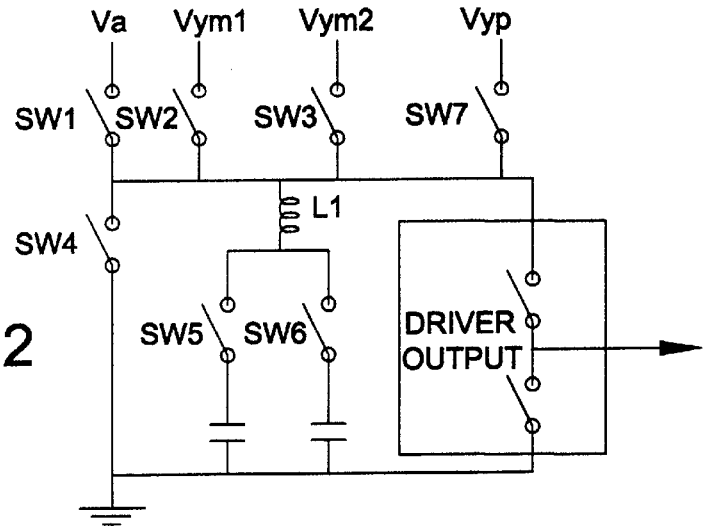
Figure 13:
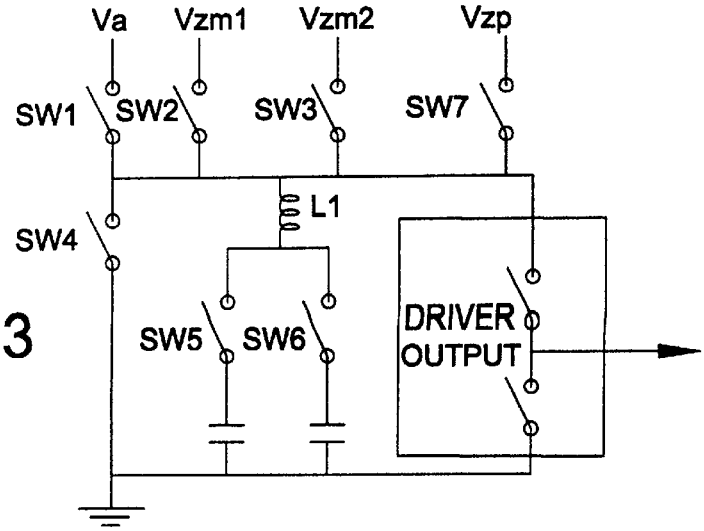

FIG. 6 *a,b*, and *c* illustrates mappings using 3 bits of the list address which can distribute a pattern in time and space to change perception of motion due to display updating;

FIG. 7 is a block diagram of the apparatus used to generate the preferred waveform;

FIG. 8 is a block diagram of the X driving system;

FIG. 9 is a block diagram of the Y driving system;

FIG. 10 is a block diagram of the Z driving system;

FIG. 11 is a schematic diagram of the X driving system;

FIG. 12 is a schematic diagram of the Y driving system;

FIG. 13 is a schematic diagram of the Z driving system ; and

Figure 14:
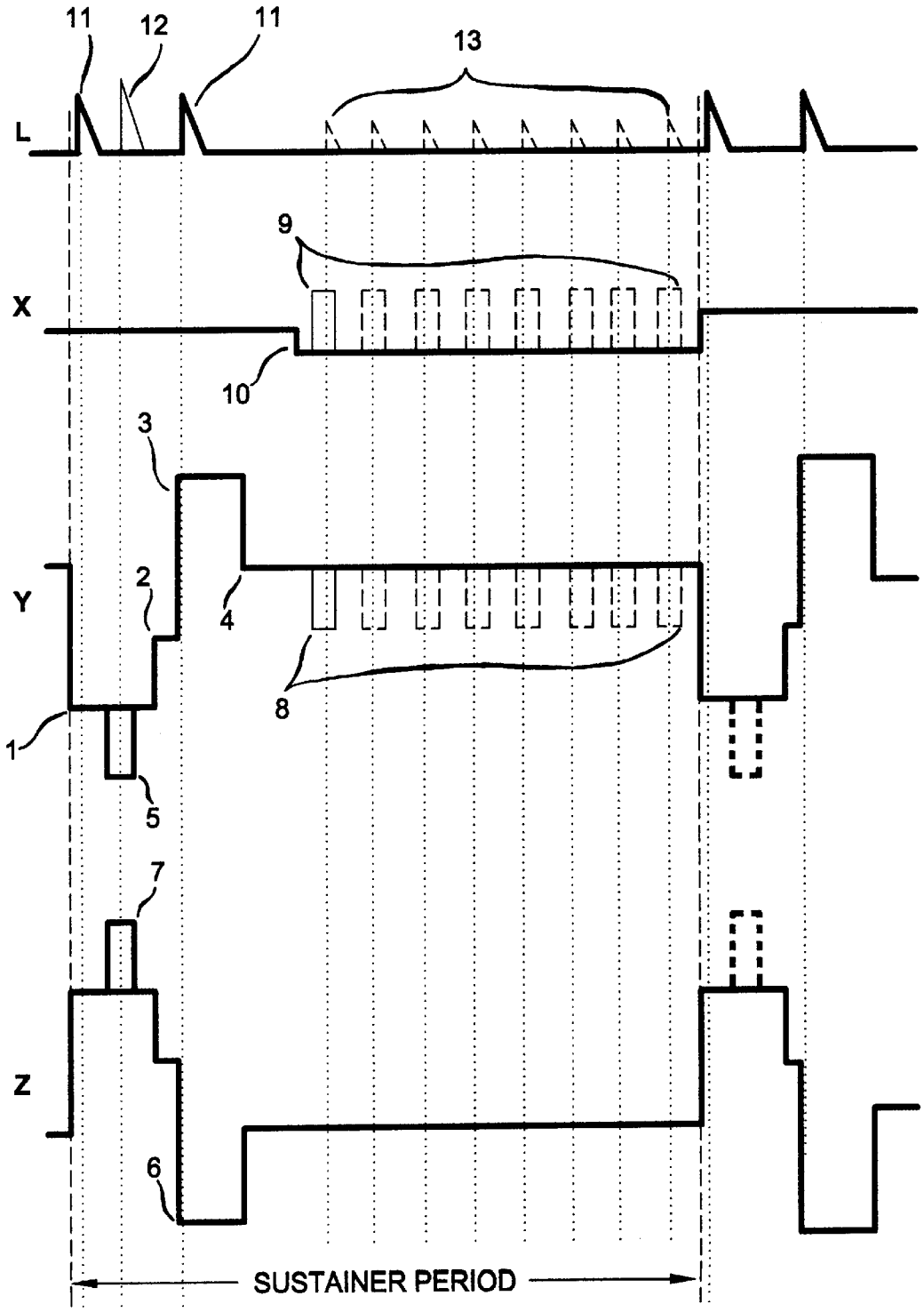

FIG. 14 illustrates the preferred waveform for a MOG PDP

Figure 15A:
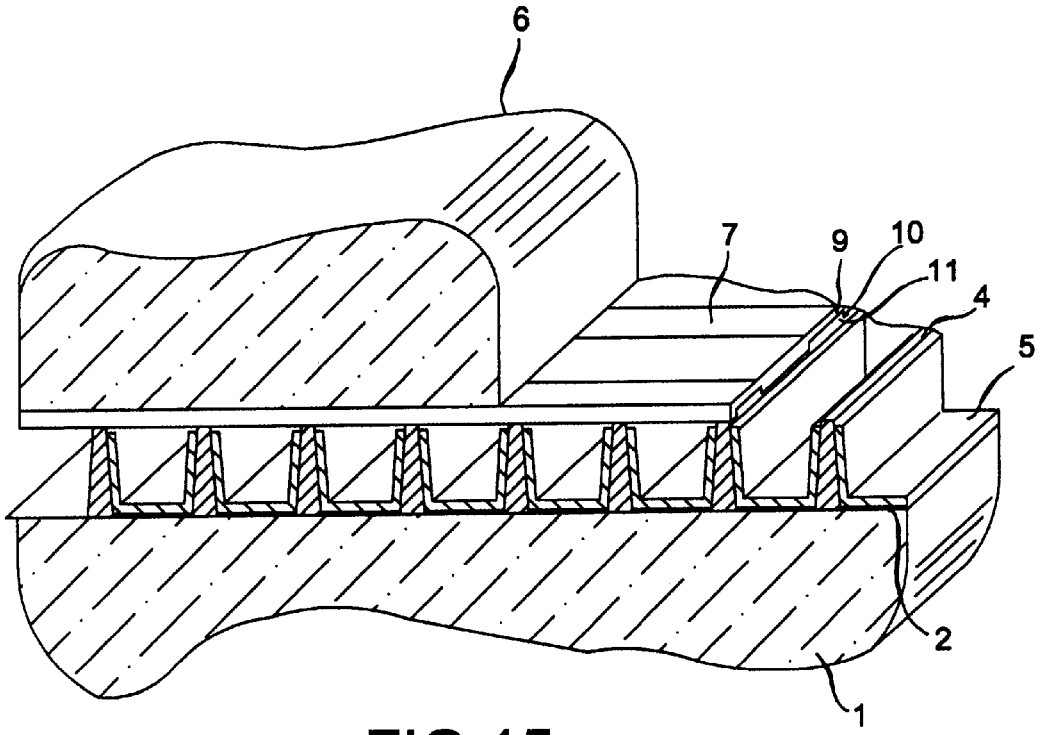
Figure 15B:
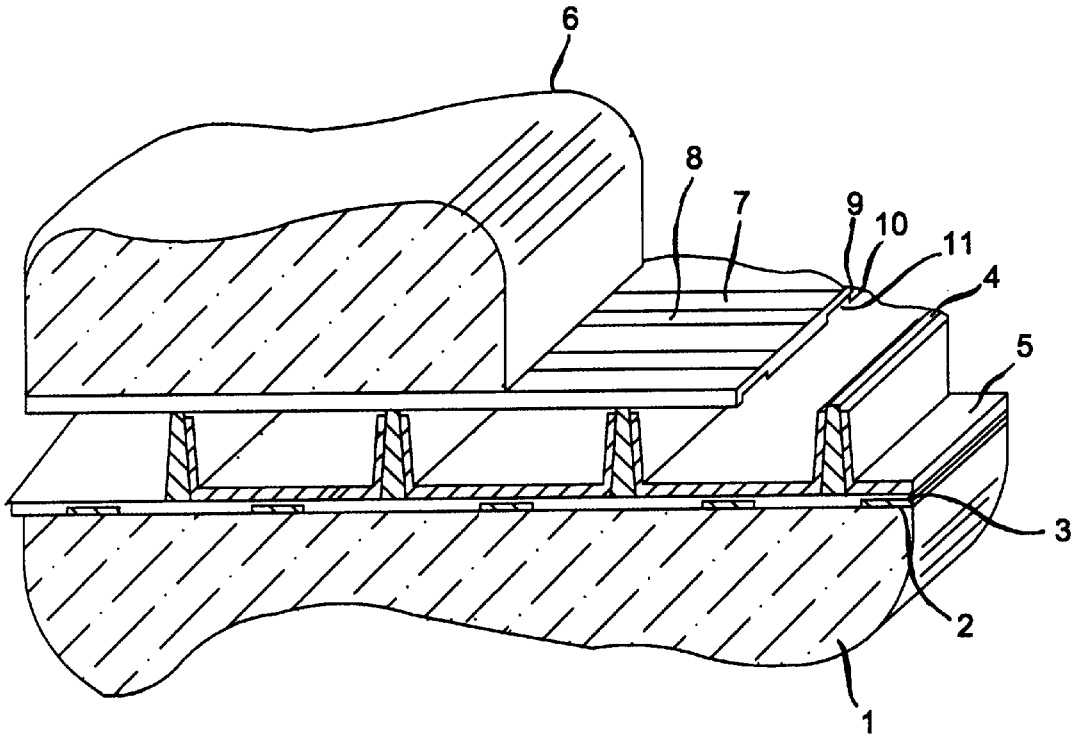

FIG. 15 illustrates the geometry of a MOG PDP.

DESCRIPTION OF THE PREFERRED EMBODIMENTS

Figure 1:
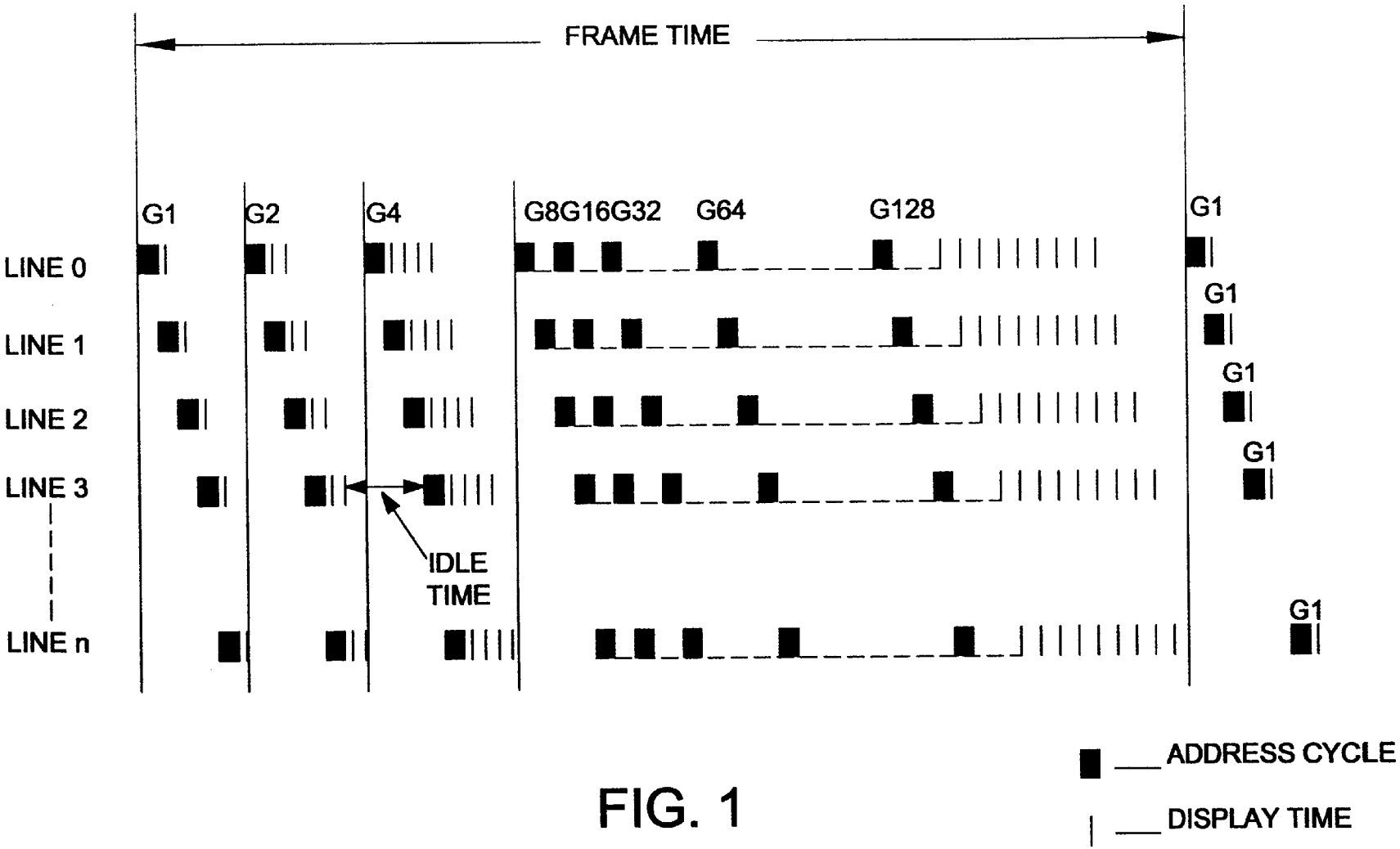
FIG. 1 (PRIOR ART)
Figure 2:
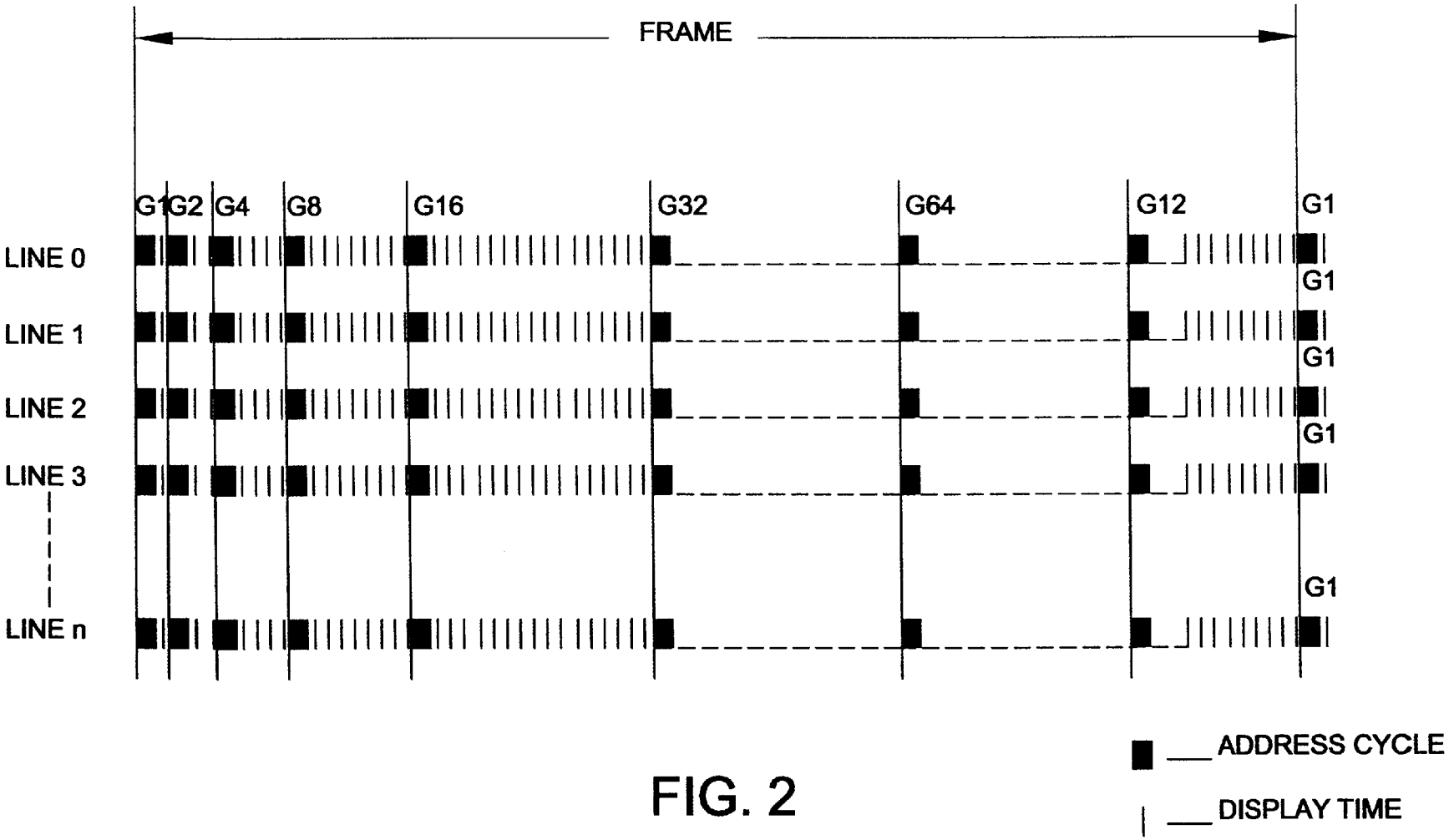
FIG. 2 (PRIOR ART)
Figure 3:
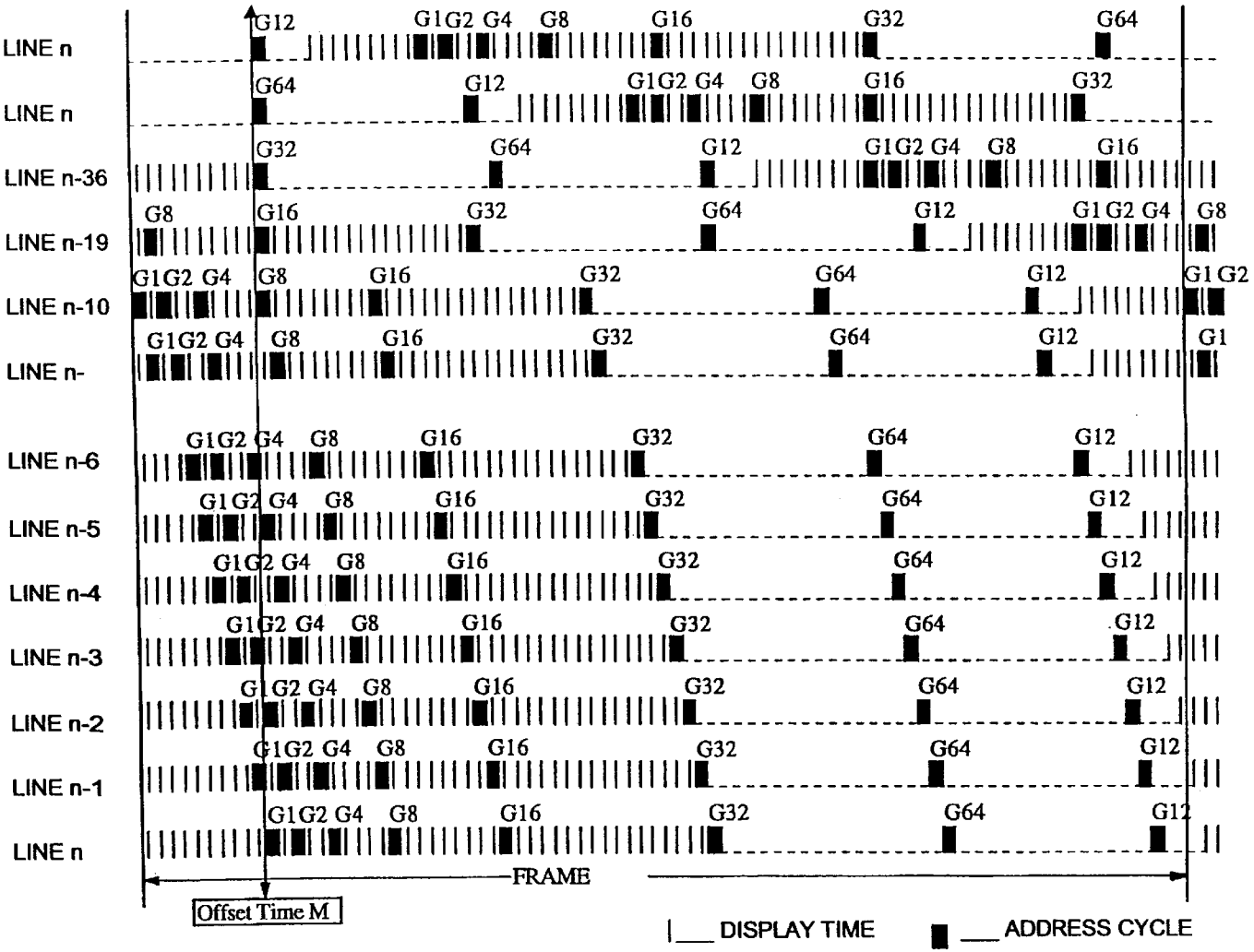
FIG. 3 illustrates the structure of a distributed line addressing of the present invention.

When referring to the figures it will be appreciated that for purposes of clarity some details of construction have not been provided in view of such details being conventional and well within the skill of the art once the invention is disclosed and explained. Referring to the drawings, wherein like reference characters represent like elements, FIG. 3 schematically illustrates a line-time distribution structure of one embodiment of the present invention. Each line 10 consists of a row of pixels 12, which commonly consists of three color subpixels at each pixel position. These row lines of pixels are arranged vertically forming a matrix. Each row line of pixels 12 is capable of being addressed simultaneously. Each subpixel has commonly an 8 bit value associated with it referred to as its grayscale value. Such a display is algorithmically color blind, i.e., the addressing scheme is identical for every pixel regardless of its intended color. Colors may thus be arranged in stripes or matrices depending on specific display characteristics.

A horizontal display line is assigned a time period equal to the time required to display an image frame of information on the digital display. This line time period is divided into a plurality of eight sub-periods identified as G1, G2, G3, G4, G5, G6, G7 and G8. Each sub-period (G1–G8) has a different time length determined by the binary weighting of the grayscale bit to be displayed during that period. Addressing may take place only at the beginning of a sub-period, which coincides with the end of the previous sub-period. Optimally these subperiods are not distributed sequentially in time as their binary weights as shown, but in a mixed order. The visual brightness for each pixel on the line is the accumulation of the display times for each of the eight sub-periods G1–G8. Thus, 256 levels of gray may be composed of the 8 bits determined for each pixel by selectively operating one or more of the eight sub-periods G1–G8.

Each horizontal line is assigned sub-periods with an identical binary weighting pattern. However, the display time for sub-period G1 is offset from sub-period G1 for the previous line by a time equal to the frame time divided by the number of horizontal lines in the display. Thus all lines have a unique starting time for their respective G1 sub-period. Further, it can be seen that an address event must occur somewhere in the display at the beginning of each sub-period.

FIG. 3 illustrates that line Offset time M marks the beginning of eight sub-periods; G1 for line N, G2 for line N-2, G4 for line N-5, G8 for line N-10, G16 for line N-19, G32 for line N-36, G64 for line N-69, and G128 for line N-134. Thus at each offset time, a grid consisting of eight horizontal lines must undergo pixel updates to illunminate pixels for the new sub-periods with the first grid line displaying pixels for sub-period G1, etc.

Figure 4:
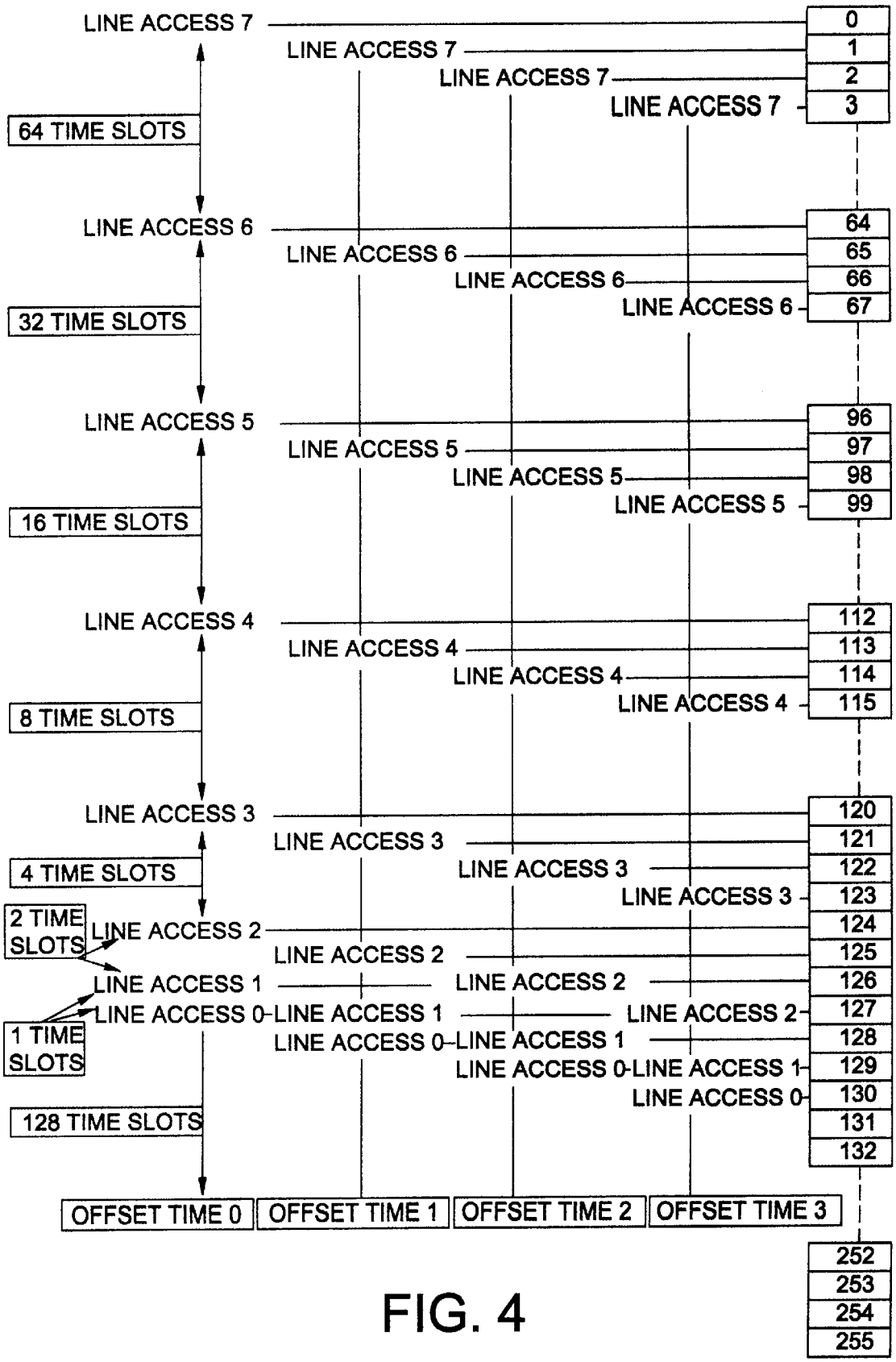
FIG. 4 illustrates the implementation of the distributed line addressing technique using sequentially structured line patterns.

FIG. 4 illustrates a method by which lines may be chosen for updating. In this case, for example, the display consists of 256 horizontal lines listed in the table of FIG. 4. During the first Offset time, a set of eight grid lines indicated as Line Access 0 to Line Access 7 selects the display lines that will be addressed from the list of all available lines indicated by the list of addressable lines 0 to 255. Thereafter, the set of grid lines is moved down one position in the Addressable Line List to determine which display lines will be updated during Offset time 1. The grid line set is moved one position for each Offset time until the grid line set has accessed each location in the list. When a grid line reaches the bottom of the list, that grid line will move to the top of the list after the next increment. Since the Offset time period is the frame time divided by the number of lines in the list, the time required to access each location in the Addressable Line List is equal to one frame time during which each display line will have been accessed eight times.

The grid lines described and shown in FIG. 4 are separated (spaced) by the number of positions in the addressable line list and that separation determines the binary weighting bases on the grayscale values. For displays larger than 256 lines, the grid line spacing will be increased by the factor (Ld/256) where Ld is the number of lines in the display. The grid line spacing can be varied to effectively change the order of occurrence of the grayscale weightings such that the time dependencies can be avoided.

The implementation illustrated in FIG. 4 has the disadvantage of assigning line offsets on a sequential basis. This type of assignment invites visual effects as grayscale brightness of adjacent lines change even in small amounts but with major shifts in pulse timing within a frame period. The eye-brain cell structure can, for example, easily perceive this as motion. These are the image artifacts that have been observed with digital "pulse modulation" techniques.

Figure 5:
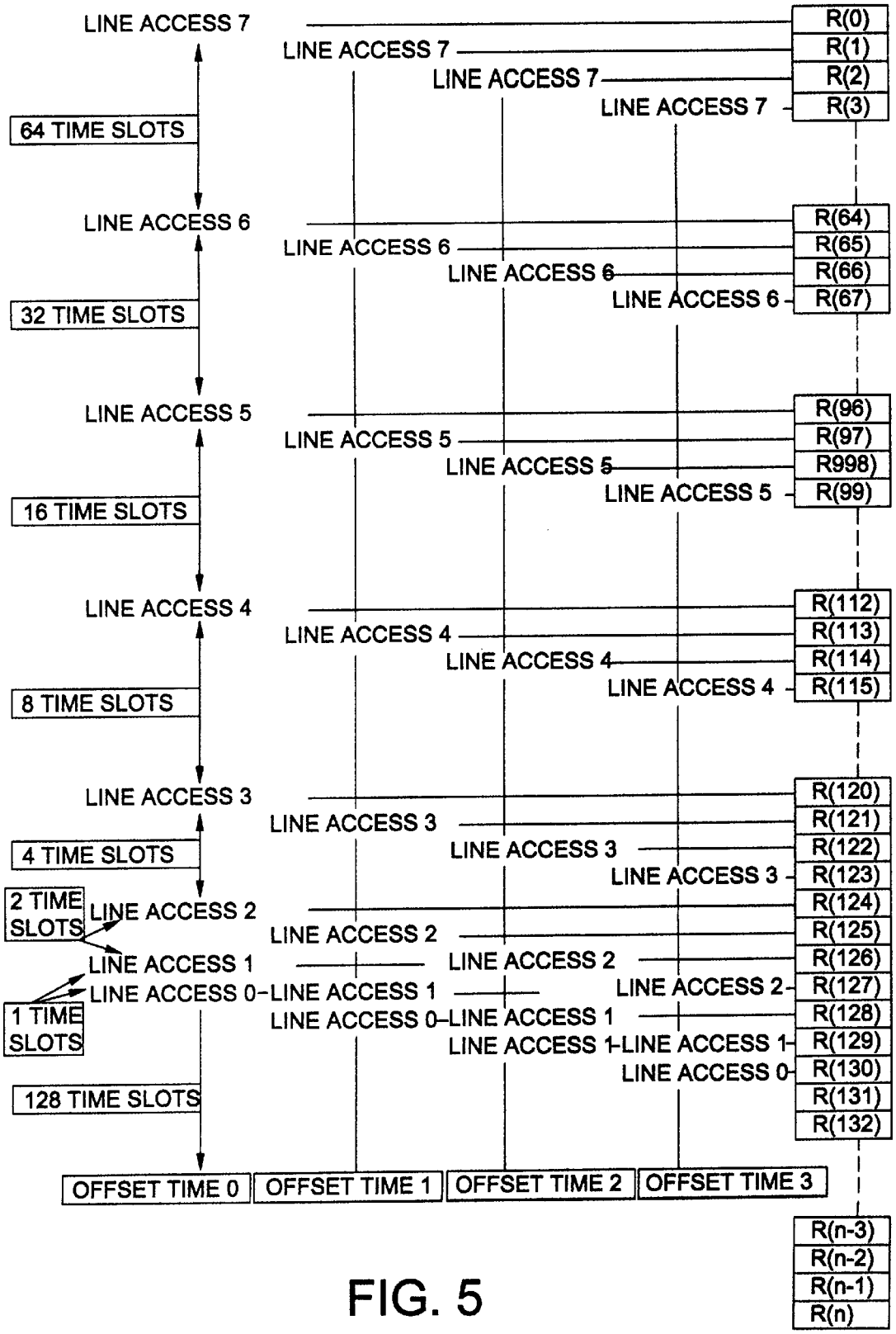
FIG. 5 illustrates the implementation of the distributed line addressing technique using randomly structured line patterns.

Assigning line positions in the Addressable Line List in an ordered distribution, which will be perceived as sudo-random or scattered can mitigate these image artifacts. In this case, the time modulated digital pulses, which occur at each color subpixel, appear to have a combined "random" occurrence over time and space and motion is not detected by the eye-brain nerve structure. FIG. 5 illustrates a "randomly" assigned line list where R(N) is a random line number for list position N. Assigning display lines such psuedo-random positions in the Addressable Line List results in a spatial scattering of the "pulse-width modulation" display times and avoids visual effects.

Figure 6A:
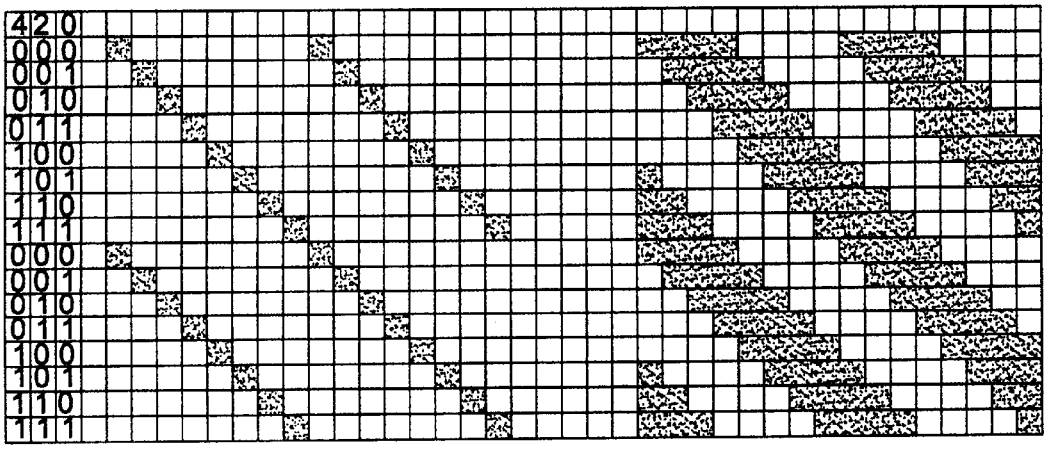
Figure 6B:
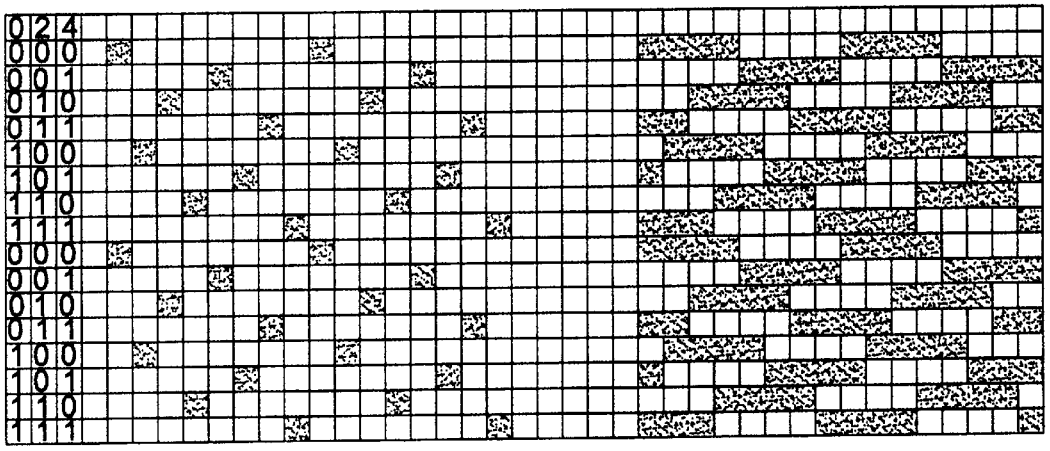
Figure 6C:
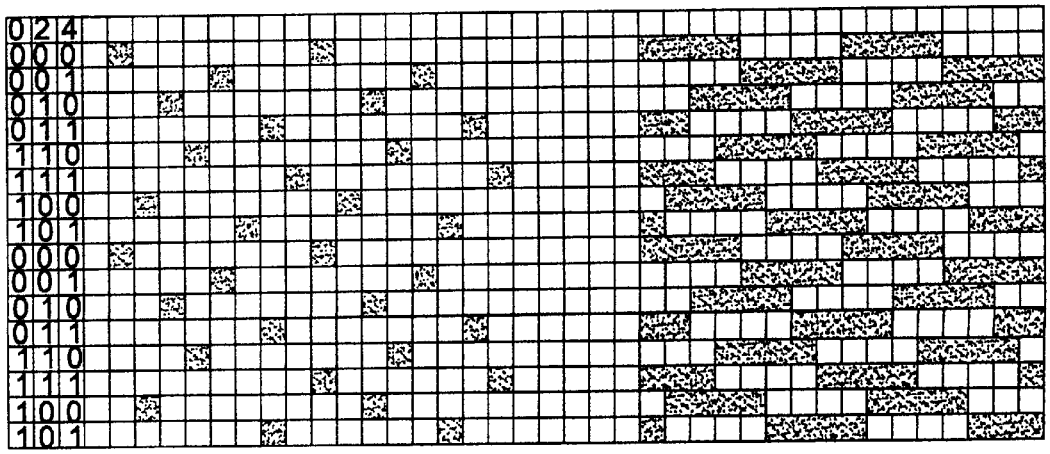

FIG. 6 illustrates how a pattern can appear to move in time if not distributed also in space. In FIG. 6*a* are shown two patterns, one of mostly on cells and one of mostly off, which when sequentially updated appear to move in space—the eye can follow the diagonal bars. In FIG. 6*b* the patterns are "mixed up" in space by reversing three space bits. In FIG. 6*c* the mixing is more complex utilizing exclusive OR in conjunction with reversing. In this way it is arranged so that there is no pattern for the eye to follow.

This technique removes most image artifacts except that which is produced by the digitalization of the image itself over time. This happens when a grayscale value at a bit boundry causes oscilation between two digital values from frame to frame which map into a movement pattern. This final problem can be removed by simple hysteresis on a pixel by pixel basis from frame to frame.

By this means, there is provided a novel and simple way of generating the required addressable lines by use of a set of grid lines that may be implemented as either a simple sequence generator or as a look-up table and distributes the grayscales in randomly perceived patterns in both space and time.

FIG. 14 illustrates the waveforms of the preferred embodiment that meet the necessary requirements for driving the MOG structure plasma display as illustrated in FIG. 15. A front or top substrate 6 has on its interrior surface display electrodes 7 electrodes 7, also referred to as Y and Z sustainer electrodes, covered with dielectric material 9 which has applied to its surface a photoemissive layer 10. The front substrate is sealed to a back substrate 1 containing luminescent areas 5 on the surfaces of microgrooves separated by a thin barrier 4. On the areas 5 are deposited phosphor material on and coincident with electrodes 2 covering the interior surfaces of the micro-grooves. Each adjacent luminescent area may contain a different phosphor color, for example, red [R], green [G], and blue [B] in a repetitive pattern. An image element is typically defined by at least three luminescent areas 5 corresponding to the above three colors.

In FIG. 14, L represents the light output from a selected cell, X is the waveform applied to the address electrode of the selected cell, Y is the voltage applied to the Y display electrode of the selected cell, and Z is the Z voltage applied to the Z electrode of the selected cell. Y and Z are of equal amplitude and have opposite polarity. As Y transitions to the low level 3, Z transitions to the high level 1 and thus a voltage is applied to the cell of amplitude Va and this causes a previously ON cell to discharge resulting in a light output pulse 12. At the next step, Y transitions to the high level 1, Z transitions to the low level and this results in the application of a negative voltage to the cell of amplitude Va and the ON cell again discharges and creates a light output. If the previous state of the cell was OFF, the transitions of Y and Z will not be large enough to cause the OFF cell to discharge and the cell will remain in the OFF condition.

Write addressing is shown in FIG. 14 as the application of a negative pulse 5 to the Y display electrode and a positive pulse 7 to the Z display electrode. If the height of the pulse 5 is Vw1 and the height of pulse 7 is Vw2, then the voltage across the addressed cell is Va+Vw1+Vw2 and this voltage must be greater than Vfmax1+Vfmax2 described above in order to cause a discharge between the two display electrodes. The application of these pulses causes the cells on the line formed by the Y and Z electrode to discharge and collect wall charges on the front substrate of sufficient applitude so that on the next transition of the Y and Z electrodes (indicated by 6 in FIG. 14), the cell again discharges and becomes ON. In this manner, all cells on the horizontal line formed by the Y and Z electrodes will be written.

It will be appreciated that not all cells on the addressed horizontal line should remain in the ON state. It therefore becomes necessary to selectively erase those cells that must be OFF. This is accomplished by the application of erase pulses 8 to the Y display electrode and erase pulses 9 to the address electrode X. If the height of the Y pulse 8 is Vw1, a common supply can be used to generate both the write and erase pulse heights for the Y electrode resulting in a simplification of the power supply for the display. The address pulse height 9 of value Ve1 must then be chosen so that Vw1+Ve1 must be greater that Vfmax1 in order to cause a discharge between the Y electrode and the address electrode X in order for the selected cell that is to be turned OFF. The application of the erase pulse results in a wall charge of same polarity for the Y and Z electrode and the wall voltage is reduced to a level that does not satisfy equation (a) and the cell is extinguished.

In order to accomplish the distributed line addressing method of grayscale. Eight horizontal lines are written at the same time using the same pulses 5 and 7 shown in FIG. 14. Eight separate erase pulses are then sequentially applied to those eight lines. Each of the erase pulses is used to extinguish unwanted cells on those eight addressed lines. This is illustrated in FIG. 14 where horizontal lines L1, L2, . . . L8 have all cells written with pulses 5 and 7 and then the first erase pulse 8 is used to selectively erase the unwanted cells on L1, the second pulse is used to selectively erase the unwanted cells on L2, the third pulse is used to selectively erase the unwanted cells on L3, etc. until all eight lines have unwanted cells in the OFF state.

FIG. 7 illustrates the block diagram of a system that is used to generate the waveforms and data necessary to drive the MOG structure. The input to the system is control signals for identifying the horizontal and vertical synchronizing signals, the data for red, green, and blue information for each pixel in the display and a clock to indicate new pixel information. The pixel data is converted to binary form and stored in a frame memory for later retrieval. The Timing Control unit synchronizes with the sync signals and controls the waveform generator. The waveform generator is responsible for sending horizontal address information to the Y and Z drive circuits, and for generating signals that are used to generate the Y and Z waveforms. Horizontal lines are written in groups of eight and the waveform control unit selects which horizontal lines make up the selected set. The selected group are bulk written and then those lines are selectively erased.

The Data Transform block selects information from the frame buffer based on the selected horizontal line to be erased and which bit in the grayscale value of eight bits is to be used for selecting the erase pattern. Thus the Data Transform block is responsible for manipulating the frame buffer data so that grayscale information can be properly displayed on the plasma screen.

FIG. 8 illustrates the detailed block diagram for the address electrode (X) drive circuit. The Pulse Generator selects one of three levels to apply to the driver circuits. The Vxw level is used to generate the pulse height of the erase pulses for selected cells, the ground levels is used for unselected cells, and the Vxm level is used when no erase pulses are being generated during the normal sustain time. Energy recovery circuits are used to increase efficiency when driving the capacitance of the address electrodes and is used for both the address pulse voltages (Vxw) and the Vxm level. Data to the X drive circuits is determined by the Data Transform block shown in FIG. 7.

FIG. 9 illustrates the detailed block diagram for the Y display electrode drive circuit. The Y Sustain block generates the sustaining waveform 2 shown in FIG. 14. The controls for the timing of the waveform is determined by the Waveform Control block of FIG. 7. The Y Sustain Block selects between the sustain voltage Va and the two intermediate levels Vym1 and Vym2. Vym2 is the level from which erase pulses are applied. Energy recovery circuits are used to increase efficiency when driving the capacitance of the address electrodes and is used for both the sustain voltage (Va) and the Vym levels. Erase and write address pulses are generated by the Y Pulse control block. The same pulse height is used for both erase and write pulses. The Y driver circuit chooses lines to write and erase based on Y data from the Waveform Control block. The data is used to apply or not apply the erase and write pulses to each of the horizontal lines in the display.

FIG. 10 illustrates the detailed block diagram for the Z display electrode drive circuit. The Z Sustain block generates the sustaining waveform 6 shown in FIG. 14. The Waveform Control block of FIG. 7 determines the controls for the timing of the waveform. The Z Sustain Block selects between the sustain voltage Va and the two intermediate levels Vzm1 and Vzm2. Vzm2 is the level from which erase pulses are applied. Energy recovery circuits are used to increase efficiency when driving the capacitance of the address electrodes and is used for both the sustain voltage (Va) and the Vim levels. Write address pulses are generated by the Z Pulse control block. The Z driver circuit chooses lines to write based on Z data from the Waveform Control block. The data is used to apply or not apply the write pulses to each of the horizontal lines in the display. Note that since the Z and Y block diagrams are so closely related, the same circuitry can be used for both the Z and Y electrodes. It will be appreciated that this results in a savings of both design, assembly, and circuit costs.

FIG. 11 schematically illustrates a typical circuit for generating the required waveform for the address (X) electrodes. Switches SW1, SW2, and SW3 control the voltage that will be applied to the driver. The two switches inside the driver device select either the applied voltage (when the upper switch is ON, lower switch is OFF) or the common level ground (when the lower switch is ON, upper switch is OFF). The driver switches are controlled by the data bits loaded into the driver circuit by the Data Transform block shown in FIG. 7. SW1 of FIG. 11 is closed and SW2 and SW3 are open whenever the address electrode is to be pulsed with voltage VAX. SW2 is closed and SW1 and SW3 are open whenever there is only sustain activity and X is held at the medium voltage Vxm. Sw3 is closed and SW1 and SW2 are open whenever the address electrode is to be at the ground level. This occurs between the address erase pulses. Energy recovery is performed by switches SW4 and SW5. SW4 is closed whenever the applied voltage is to transition from ground to Vxa or from Vxa to ground. On the transition from Vxa to ground, the capacitor is charged through the inductor L1. On the transition from ground to Vxa, he capacitor is discharged through the inductor L1. Thus the capacitor average voltage will be ½ Vxa. Energy recovery for the Vxm levels is accomplished by SW5. SW5 is closed whenever the applied voltage is to transition from ground to Vxm or from Vxm to ground. On the transition from Vxm to ground, the capacitor is charged through the inductor L1. On the transition from ground to Vxm, the capacitor is discharged through the inductor L1. Thus the capacitor average voltage will be ½ Vxm. It is important to have only one switch closed at any given time. SW4 and SW5 are used for the transitions and SW1, Sw2, and SW3 are used to clamp the voltages at their corresponding levels.

FIG. 12 schematically illustrates a typical circuit for generating the required waveform for the Y display electrode. Switches SW1, SW2, and SW3 control the voltage that will be applied to the Y driver. The two switches inside the driver device select either the applied voltage (when the upper switch is ON, lower switch is OFF) or the common level ground (when the lower switch is ON, upper switch is OFF). The driver switches are controlled by the data bits loaded into the driver circuit by the Waveform Control block shown in FIG. 7. SW1 of FIG. 12 is closed and SW2, SW3, and SW4 are open whenever the display electrode is to be pulsed with the sustaining voltage Vya. SW2 is closed and SW1, SW3 and SW4 are open whenever the sustain waveform is to be held at intermediate voltage Vym1. Sw3 is closed and SW1, SW2, and SW4 are open whenever the display electrode is to be at the second intermediate level Vym2. This occurs during the address erase pulses. Sw4 is closed and SW1, SW2, and SW3 are open whenever the display electrode is to be at the ground level. Switches SW5 and SW6 perform energy recovery. SW5 is closed whenever the applied voltage is to transition from Vym1 to Vya or from Vya to Vym1. On the transition from Vya to Vym1, the capacitor is charged through the inductor L1. On the transition from Vym1 to Vya, the capacitor is discharged through the inductor L1. Thus the capacitor average voltage will be ½ (Vya+Vym1). Energy recovery for the Vym2 levels is accomplished by SW6. SW6 is closed whenever the applied voltage is to transition from ground to Vym2 or from Vym2 to ground. On the transition from Vxm to ground, the capacitor is charged through the inductor L1. On the transition from ground to Vxm, the capacitor is discharged through the inductor L1. Thus the capacitor average voltage will be ½ Vxm2. It is important to have only one switch closed at any given time. SW4 and SW5 are used for the transitions and SW1, Sw2, and SW3 are used to clamp the voltages at their corresponding levels.

FIG. 13 schematically illustrates a typical circuit for generating the required waveform for the Z display electrode. Switches SW1, SW2, and SW3 control the voltage that will be applied to the Z driver. The two switches inside the driver device select either the applied voltage (when the upper switch is ON, lower switch is OFF) or the common level ground (when the lower switch is ON, upper switch is OFF). The driver switches are controlled by the data bits loaded into the driver circuit by the Waveform Control block shown in FIG. 7. SW1 of FIG. 13 is closed and SW2, SW3, and SW4 are open whenever the display electrode is to be pulsed with the sustaining voltage Vza. SW2 is closed and SW1, SW3 and SW4 are open whenever the sustain waveform is to be held at intermediate voltage Vzm1. Sw3 is closed and SW1, SW2, and SW4 are open whenever the display electrode is to be at the second intermediate level Vzm2. This occurs during the address erase pulses. Sw4 is closed and SW1, SW2, and SW3 are open whenever the display electrode is to be at the ground level. Switches SW5 and SW6 perform energy recovery. Energy recovery for the Z display electrode is similar to that described above for the Y display electrode. It is important to have only one switch closed at any given time. SW4 and SW5 are used for the transitions and SW1, Sw2, and SW3 are used to clamp the voltages at their corresponding levels.

The patents and documents referenced herein are hereby incorporated by reference in their entirety.

Having described presently preferred embodiments of the present invention, it is to be understood that it may be otherwise embodied within the scope of the appended claims.

We therefore claim:

1. A method of generating perceived grayscale for an image frame of Y by X size with P bits grayscale depth per pixel in a display system having N rows and X columns of pixels, such pixels allowed to be either off or on at any instant in time, and in which all pixels along selected rows can be updated in parallel, such method producing a unique interleave of both time and spacial distribution of on/off states perceived as grayscale and comprising:

in a first cycle selecting from a logical list or algormithic computation of all rows arranged sequentially from 1 to N a sub-group, or grid, containing at least P members wherein members or sums of members of each sub-group are logarithmically related in logical position spacing but arranged in a pseudo-random distribution according to grayscale bit number which will determine an ordering in time, updating said sub-group with binary information generated from a mapping of grayscale bit values corresponding to grayscale bit positions in said sudo-random distribution, to pixels in a general mapping of said image, said general mapping being 1 to 1 and physically sequential in the X dimension but 1 to 1 and in a scattering distribution, not physically sequential, in the Y dimension determining an ordering in space, and causing light to emit or not according to all updated and previously updated pixel on/off values if light emission is not inherent in updating process;

in subsequent cycles selecting from the logical list of all rows arranged sequentially subsequent sub-groups containing above said members each wherein members of each sub-group are related and positioned in said first pseudo-random distribution and are sequential neighbors of previous selected sub-groups, said sub-groups updated with binary information generated from a mapping of grayscale bit values corresponding to grayscale bit positions in said pseudo-random distribution, to pixels in a general mapping of said image, said general mapping being 1 to 1 and physically sequential in the X dimension but 1 to 1 and in said scattering distribution, not physically sequential, in the Y dimension, and causing light to emit or not according to all updated and previously updated pixel on/off values if light emission is not inherent in updating process, such cycles to continue until all Y rows have been chosen completing a frame; and immediately and continuously repeating such cycling for subsequent frames which may contain new image information.

2. A method according to claim 1 where the logarithmic relationship is binary.

3. A method according to claim 2 where the number of grayscale bits are 8.

4. A method according to claim 3 where the minimum number of Y rows is 256.

5. A method according to claim 1 where the pseudo-random distribution has the most significant bit at mid cycle in time.

6. A method according to claim 5 where the number of grayscale bits are 5 and where the first psuedo-random distribution is according to the bit positions 2nd, 3rd, 4th (most significant), 0 (least significant), and 1st and the scattering distribution is neighbor, ½ frame neighbor, ¼ frame neighbor, ¾ frame neighbor, and continuing until all Y/N groups are exhausted.

7. A method according to claim 1 where the number of grayscale bits are 8 and the first psuedo-random distribution is according to the bit positions 0 (least significant), 2nd, 4th, 6th, 7th (msb), 5th, 3rd, and 1st.

8. A method according to claim 1 where the number of grayscale bits are 8 and the first psuedo-random distribution is according to the bit positions 3rd, 0 (least significant), half of 7th (msb), 5th, 6th, 4th, half of 7th (msb), 2nd and 1st.

9. A method according to claim 1 where the scattering distribution is determined from the first three binary bits the list address.

10. A method according to claim 9 where the mapping is accomplished by reversing the order of the first three bits of the list address.

11. A method according to claim 9 where the mapping is accomplished by reversing the order of the first three bits of the list address and performing the logical operation of exclusive OR of the 2nd and 3rd to obtain the values in the second for the mapping function.

12. A method according to claim 1 where the X pixels are grouped in triads of red, green, and blue emitters or reflectors so as to cause color grayscale images to be perceived.

13. A method according to claim 1 where the display is an AC plasma display comprising a hermetically sealed gas filled enclosure, said enclosure including a top transparent substrate having an array of paired top substrate electrodes, an insulating film covering said top substrate electrodes possibly with microchannels parallel to said electrodes, and an electron emissive surface; a bottom substrate spaced from but in contact with said top substrate, said bottom substrate having a plurality of parallel microgrooves arranged orthogonally to said top substrate electrodes forming gas filled cavities; bottom substrate electrodes formed of metal parallel to and corresponding to microgrooves; and a phosphor material deposited within the microgrooves and over bottom substrate electrodes thereby forming sub-cell pairs called sub-pixels at the projected intersections of top electrodes forming rows and bottom electrodes forming columns.

14. A method according to claim 1 where the display is an AC plasma display comprising a hermetically sealed gas filled enclosure, said enclosure including a top transparent substrate having an array of paired top substrate electrodes, an insulating film covering said top substrate electrodes with microchannels parallel to said electrodes, and an electron emissive surface; a bottom substrate spaced from but in contact with said top glass substrate, said bottom substrate having a plurality of parallel microgrooves arranged orthogonally to said top substrate electrodes; bottom substrate electrodes formed of metal and deposited within each said micro-groove including bottom and side-walls; and a phosphor material deposited on and coincident with each said bottom substrate electrode thereby forming sub-cell pairs called sub-pixels at the projected intersections of top electrodes forming rows and microgrooves forming columns.

15. A method according to claim 1 where the display is an AC plasma display comprising a hermetically sealed gas filled enclosure, said enclosure including a top transparent substrate having an array of paired top substrate electrodes and an electron emissive and insulating film covering said top substrate electrodes; a bottom substrate spaced from but in contact with said top substrate, said bottom substrate having a plurality of parallel micro-grooves arranged orthogonally to said top substrate electrodes; a bottom substrate electrode formed of metal and deposited within each said micro-groove including bottom and side-walls; and a phosphor material deposited on and coincident with each said bottom substrate electrode thereby forming sub-cell pairs called sub-pixels at the projected intersections of top electrodes forming rows and microgrooves forming columns.

16. The method according to claim 1 where hystresis is applied on a pixel to pixel bases between sequential images of sequential frames.

17. An apparatus for operating AC plasma displays comprising:

a hermetically sealed gas filled enclosure, said enclosure including a top transparent substrate having an array of paired top substrate electrodes and an electron emissive and insulating film covering said top substrate electrodes; a bottom substrate spaced from but in contact with said top substrate, said bottom substrate having a plurality of parallel micro-grooves arranged orthogonally to said top substrate electrodes; bottom substrate electrodes formed of metal and deposited within each said micro-groove including bottom and side-walls; and a phosphor material deposited on and coincident with each said bottom substrate electrode thereby forming sub-cell pairs called sub-pixels at the projected intersections of top electrodes forming rows and microgrooves forming columns;

a first circuit connected to each first of paired top glass substrate electrodes for generating a common multi level sustain waveform with a selective negative addressing pulse for each electrode;

a second circuit connected to each second of paired top glass substrate electrodes for generating a common multilevel sustain waveform of opposite polarization and amplitude from the first with a selective positive addressing pulse for each electrode;

a third circuit connected to each electrode on bottom substrate for generating a common multi level sustain waveform with a selective positive addressing pulse for each electrode;

an input converter, frame buffer, and data transform circuit containing predetermined list and mapping means from frame buffer to displayed pixel with external interface configured to an industry standard data source capable of transferring row data in parallel to said third circuit;

a waveform and waveform timing control circuit interconnected with said first four circuits and determinant of timing and control of said sustaining circuits and addressing pulses so as to create sustain and address discharge pulses initiated by discharges to sidewalls thereby lowering address voltages and such that lignt emission occurs uniquely on each display row in time blocks of repetitive stable pulse sequences of length determined by the logarithmic relationship per grayscale bit per pixel, said time blocks distributed psuedo-random and not sequential in time according to predetermined list or algormithic computation, and row to row timings arranged not sequential but scattered in both space and time relative to neighboring rows throughout the display also according to said list or algormithic computation; and a power circuit capable of supplying necessary power to said first five circuits, said power being converted from an industry standard power source.

18. An apparatus for operating AC plasma displays comprising:

a hermetically sealed gas filled enclosure, said enclosure including a top glass substrate having an array of paired top glass substrate electrodes, an insulating film covering said top glass substrate electrodes with microchannels parallel to said electrodes, and an electron emissive surface; a bottom substrate spaced from but in contact with said top glass substrate, said bottom substrate having a plurality of parallel micro-grooves arranged orthogonally to said top substrate electrodes; bottom substrate electrodes formed of metal and deposited within each said micro-groove including bottom and side-walls; and a phosphor material deposited on and coincident with each said bottom substrate electrode thereby forming sub-cell pairs called sub-pixels at the projected intersections of top electrodes forming rows and microgrooves forming columns;

a first circuit connected to each first of paired top glass substrate electrodes for generating a common multi level sustain waveform with a selective negative addressing pulse for each electrode;

a second circuit connected to each second of paired top glass substrate electrodes for generating a common multilevel sustain waveform of opposite polarization and amplitude from the first with a selective positive addressing pulse for each electrode;

a third circuit connected to each electrode on bottom substrate for generating a common multi level sustain waveform with a selective positive addressing pulse for each electrode;

an input converter, frame buffer, and data transform circuit containing predetermined list and mapping means from frame buffer to displayed pixel with external interface configured to an industry standard data source capable of transferring row data in parallel to said third circuit;

a waveform and waveform timing control circuit interconnected with said first four circuits and determinant of timing and control of said sustaining circuits and addressing pulses so as to create sustain discharge pulses initiated by discharges to sidewalls and address pulses to tunnel through microchannels during addressing thereby lowering the address voltage and such that lignt emission occurs uniquely on each display row in time blocks of repetitive stable pulse sequences of length determined by the logarithmic relationship per grayscale bit per pixel, said time blocks distributed psuedo-random and not sequential in time according to predetermined list or algorimithic computation, and row to row timing arranged not sequential but scattered in both space and time relative to neighboring rows throughout the display also according to said list or algormithic computation; and a power circuit capable of supplying necessary power to said first five circuits, said power being converted from an industry standard power source.

19. An apparatus for operating AC plasma displays comprising:

a hermetically sealed gas filled enclosure, said enclosure including a top glass substrate having an array of paired top glass substrate electrodes, an insulating film covering said top glass substrate electrodes with microchannels parallel to said electrodes, and an electron emissive surface; a bottom substrate spaced from but in contact with said top glass substrate, said bottom substrate having a plurality of parallel microgrooves arranged orthogonally to said top substrate electrodes bottom substrate electrodes formed of metal parallel to and corresponding to microgrooves; and a phosphor material deposited within the microgrooves and over bottom substrate electrodes thereby forming sub-cell pairs called sub-pixels at the projected intersections of top electrodes forming rows and bottom electrodes forming columns;

a first circuit connected to each first of paired top substrate electrodes for generating a common multi level sustain waveform with a selective negative addressing pulse for each electrode;

a second circuit connected to each second of paired top substrate electrodes for generating a common multilevel sustain waveform of opposite polarization and amplitude from the first with a selective positive addressing pulse for each electrode;

a third circuit connected to each electrode on bottom substrate for generating a common multi level sustain waveform with a selective positive addressing pulse for each electrode;

an input converter, frame buffer, and data transform circuit containing predetermined list and mapping means from frame buffer to displayed pixel with external interface configured to an industry standard data source capable of transferring row data in parallel to said third circuit;

a waveform and waveform timing control circuit interconnected with said first four circuits and determinant of timing and control of said sustaining circuits and addressing pulses so as to create address pulses to tunnel through microchannels during addressing thereby lowering the address voltage and such that lignt emission occurs uniquely on each display row in time blocks of repetitive stable pulse sequences of length determined by the logarithmic relationship per grayscale bit per pixel, said time blocks distributed psuedo-random and not sequential in time according to predetermined list or algormithic computation, and row to row timing arranged not sequential but scattered in both space and time relative to neighboring rows throughout the display also according to said list or algormithic computation; and a power circuit capable of supplying necessary power to said first five circuits, said power being converted from an industry standard power source.

20. An apparatus for operating AC plasma displays comprising:

a hermetically sealed gas filled enclosure, said enclosure including a top transparent substrate having an array of paired top substrate electrodes, an insulating film covering said top substrate electrodes, and an electron emissive surface; a bottom substrate spaced from but in contact with said top substrate, said bottom substrate having a plurality of parallel microgrooves arranged orthogonally to said top substrate electrodes bottom substrate electrodes formed of metal parallel to and corresponding to microgrooves; and a phosphor material deposited within the microgrooves and over bottom substrate electrodes thereby forming sub-cell pairs called sub-pixels at the projected intersections of top electrodes forming rows and bottom electrodes forming columns;

a first circuit connected to each first of paired top substrate electrodes for generating a common multi level sustain waveform with a selective negative addressing pulse for each electrode;

a second circuit connected to each second of paired top substrate electrodes for generating a common multilevel sustain waveform of opposite polarization and amplitude from the first with a selective positive addressing pulse for each electrode;

a third circuit connected to each electrode on bottom substrate for generating a common multi level sustain waveform with a selective positive addressing pulse for each electrode;

an input converter, frame buffer, and data transform circuit containing predetermined list and mapping means from frame buffer to displayed pixel with external interface configured to an industry standard data source capable of transferring row data in parallel to said third circuit;

a waveform and waveform timing control circuit interconnected with said first four circuits and determinant of timing and control of said sustaining circuits and addressing pulses such that lignt emission occurs uniquely on each display row in time blocks of repetitive stable pulse sequences of length determined by the logrighmic relationship per grayscale bit per pixel, said time blocks distributed psuedo-random and not sequential in time according to predetermined list or algormithic computation, and row to row timing arranged not sequential but scattered in both space and time relative to neighboring rows throughout the display also according to said list or algormithic computation; and a power circuit capable of supplying necessary power to said first five circuits, said power being converted from an industry standard power source.

* * * * *